US006131847A

United States Patent [19]

Theilacker et al.

[11] Patent Number: 6,131,847

[45] Date of Patent: Oct. 17, 2000

[54] TURNER BAR FOR A WEB FED ROTARY PRINTING MACHINE

[75] Inventors: Klaus Theilacker, Friedberg-Rederzhausen; Anton Neumeir, Mering, both of Germany

[73] Assignee: MAN Roland Druckmaschinen AG, Offenbach am Main, Germany

[21] Appl. No.: 09/127,561

[22] Filed: Jul. 31, 1998

[30] Foreign Application Priority Data

Aug. 1, 1997 [DE] Germany ..... 197 33 270

[51] Int. Cl.[7] ..... B65H 23/32

[52] U.S. Cl. ..... 242/615.12; 242/615.4

[58] Field of Search ..... 242/615.12, 615.4, 242/615.11; 226/196.1, 97.3

[56] References Cited

U.S. PATENT DOCUMENTS

| | | | |
|---|---|---|---|
| H1210 | 7/1993 | Jansen . | |
| 2,736,106 | 2/1956 | Offen | 242/615.12 X |
| 3,053,425 | 9/1962 | Baines | 226/196.1 X |
| 3,534,893 | 10/1970 | Maxson | 242/615.12 |
| 3,986,651 | 10/1976 | Grant | 242/615.12 X |
| 4,062,484 | 12/1977 | Rausch et al. . | |
| 4,197,002 | 4/1980 | Hamaker et al. | 242/615.12 X |
| 4,197,972 | 4/1980 | Daane | 242/615.12 |
| 4,218,833 | 8/1980 | Coar | 242/615.12 X |
| 4,257,076 | 3/1981 | Shimizu et al. | 242/615.12 X |
| 4,342,413 | 8/1982 | Reba | 226/97 |
| 4,624,860 | 11/1986 | Alber et al. . | |
| 4,848,633 | 7/1989 | Hagen et al. | 242/615.12 X |
| 4,919,319 | 4/1990 | Ford et al. | 242/615.12 |
| 4,986,181 | 1/1991 | Kobayashi et al. . | |
| 5,379,694 | 1/1995 | Haek et al. . | |
| 5,423,468 | 6/1995 | Liedtke | 242/615.12 |
| 5,447,278 | 9/1995 | Lalouette et al. . | |
| 5,570,831 | 11/1996 | Takeda et al. | 242/615.12 |
| 5,577,294 | 11/1996 | Pollock | 242/615.11 X |
| 5,888,349 | 3/1999 | Lau et al. | 242/615.11 X |
| 5,893,505 | 4/1999 | Mueller | 242/615.11 X |
| 5,924,619 | 7/1999 | Bartell | 242/615.11 X |
| 5,950,899 | 9/1999 | Bassa | 226/196.1 |

FOREIGN PATENT DOCUMENTS

| | | | |
|---|---|---|---|
| 7007567 | 10/1970 | Germany . | |
| 2610956 | 9/1977 | Germany . | |
| 31 31 621 | 6/1982 | Germany . | |
| 3215472 | 11/1983 | Germany . | |
| 42 38 507 | 5/1994 | Germany . | |
| 42 42 620 | 6/1994 | Germany . | |
| 43 35 473 | 4/1995 | Germany . | |
| 5-5447 | 1/1993 | Japan | B41F 13/06 |
| 5-12203 | 3/1993 | Japan | B65H 27/00 |
| 7-101611 | 4/1995 | Japan | B65H 23/32 |
| 9-136399 | 5/1997 | Japan | B41F 13/06 |
| 2 194 918A | 3/1988 | United Kingdom | B41F 13/06 |
| 2 215 711A | 9/1989 | United Kingdom | B65H 23/24 |
| 2 283 729 | 5/1995 | United Kingdom | B65H 23/32 |

OTHER PUBLICATIONS

0630158254, Japanese Abstract.

090136399, Japanese Abstract.

Abstract for JP–7–101611 Dated: Apr. 18, 1995.

Abstract for JP–9–136399 Dated: May 27, 1997.

*Primary Examiner*—Robert P. Olszewski

*Assistant Examiner*—Collin A. Webb

*Attorney, Agent, or Firm*—Cohen, Pontani, Lieberman & Pavane

[57] ABSTRACT

A turner bar has an outer surface having a profile shaped for enabling air cushions to be built up between the outer surface and a printed material web which is fed around the turner bar. In addition, or as an alternative, a guide plate or an aerofoil profile may be arranged on the turner bar for creating the air cushion. Air may also be fed from radial holes or from holes in a guide plate to make it easier for the printed material web to slide over the turner bar.

18 Claims, 3 Drawing Sheets

TURNER BAR FOR A WEB FED ROTARY PRINTING MACHINE

BACKGROUND OF THE INVENTION

1. Field of the Invention

The present invention relates to a turner bar for a web-fed rotary printing machine.

2. Description of the Related Art

In web-fed rotary printing machines, printed material webs of one-quarter or one-half width must be offset laterally by their width or by a specific amount. The offset is achieved by the printed material web being wrapped around two turner bars by 180° in each case. In this arrangement, the two turner bars may be parallel or crossed at 90°, depending on the turning desired. While the printed material web is wrapping around these turner bars, sliding friction occurs because of the contact with the stationary turner bar. This friction influences the web tension. When ink which has not been fully dried is on the printed material web, the turner bar can cause set-off and smearing of the printed image. For these reasons, prior art turner bars circulate air around the turner bars.

A prior art turner bar of this type, to which blown air is applied, is disclosed by DE 32 15 472 C2. Pressurized air is directed to the turner bars through lines. Through specifically arranged radial holes, the air passes out of the turner bar where the moving printed material web wraps around the latter. As a result, the web floats over the turner bar with considerably reduced friction "without contact", on a moving and thus non-uniform air cushion.

Depending on the tension of the printed material web, the pressure of the air fed and the randomly more or less uniform distribution of the moving air cushion, the printed material web floats around the turner bar on a larger or smaller radius. As a result, the register offset and the axial offset of the printed web become larger or smaller. That is to say, the position of the printed material web with respect to the turning bar does not remain constant but rather runs axially, i.e., in the longitudinal direction of the turner bar, and in the circumferential direction of the turner bar.

A further disadvantage of the known turner bar to which pressurized air is applied is that paper fibers which are torn out of the printed material web in the longitudinal direction when the web is being slit, and to some extent continue to adhere to the web edge, are entrained at the turner bar by the blown air and are distributed over the entire area by the air stream. Furthermore, a constant expenditure of energy is necessary for each turner bar in order to generate the blown air. The hose runs for the compressed air are complicated, in particular if it is intended to change positions of the turner bars. If the positions of the turner bars are changed, the hose run must be carried along automatically with the turner bar, and it is necessary to compensate for different hose lengths for each position of the turner bar. A further disadvantage of using the blown air is that during the compression of the air, and during the emergence of the compressed air from the holes of the turner bars, clearly audible noise is produced.

SUMMARY OF THE INVENTION

It is the object of the invention to improve a turner bar of a web-fed rotary printing machine such that the printed material web is enabled to slide over the turner bar in a uniform manner without compressed air being introduced into the interior of the turner bar.

This object is achieved in that the turner bar of the present invention has a profile on its outer surface intended to build up an air cushion between the outer surface and the printed material web as the web is pulled around the turner bar.

A particular advantage is achieved when the surface coating used for the turner bar is an amorphous, modified, superhard carbon. Likewise, tungsten carbide is a suitable material for coating the turner bar. It is possible for the roughness which results in the case of coating with tungsten carbide to be evened out by the addition of silicone or poly-tetrafluoroethylene, this material being applied to the turner bar after the application of the tungsten carbide, so that it fills up the depressions between the tungsten carbide grains. Excess silicone or polytetrafluoroethylene is worn off the turner bar by the friction of the printed material web on the latter, so that over the course of time the result is a very smooth surface on the turner bar.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings wherein like reference characters denote similar elements through the several views.

DETAILED DESCRIPTION OF THE PRESENTLY PREFERRED EMBODIMENTS

Figure 1:
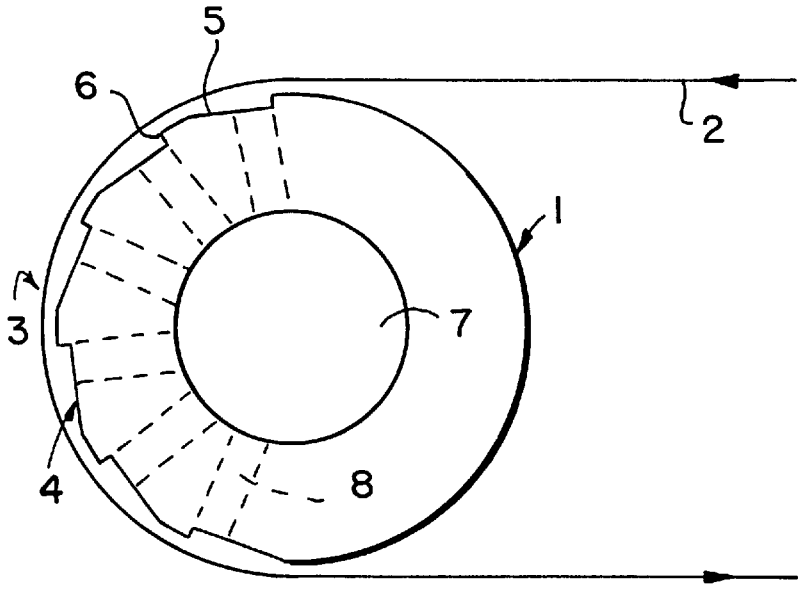
FIG. 1 shows a turner bar according to an embodiment of the present invention that is profiled over a half of the outer surface of the turner bar which the printed material web is wrapped around.

Referring to FIG. 1, a turner bar 1 according to the present invention is designed such that the friction of a printed material web 2 moving over an outer surface of the turner bar 1 is considerably reduced. An air cushion which is built up by the moving printed material web 2 in the gap between the printed material web 2 and the turner bar 1 causes the printed material web 2 to float on the turner bar 1. This embodiment produces an air cushion that is very small and therefore does not influence the exact position of the printed material web 2. The building up of the air cushion is achieved in that the turner bar 1 has sawtooth-like profiles 4 on one half 3, around which the printed material web 2 wraps. Each of the profiles 4 has a gently rising side 5 and a steeply falling side 6. The turner bar 1 has a hollow interior 7, which is connected to the gently rising sides 5 via ducts 8. Air is extracted from the interior 7 via the ducts 8. The region between the printed material web 2 and the gently rising sides 5 forms an extraction zone, in which the printed material web 2 that is moving past entrains air, which can flow along with the moving printed material web 2 via the radially arranged ducts 8 and the clear internal cross section of the interior 7. The small quantity of air which is entrained is gradually compressed in the subsequent region of the gently rising side 5, such that the printed material web 2 slides on an air cushion over the sawtooth backs of the profile 4. The sawtooth backs are formed by the transition between the sides 5 and 6 and correspond to the outer diameter of the turner bar 1. This process is repeated at the next adjacent gently rising side 5, so that the air which continuously flows out laterally from the turner bar 1 in the extraction zones while the printed material web 2 is moving around the turner bar 1 is renewed, and hence compensated for, by the feed from the ducts 8.

Figure 2:
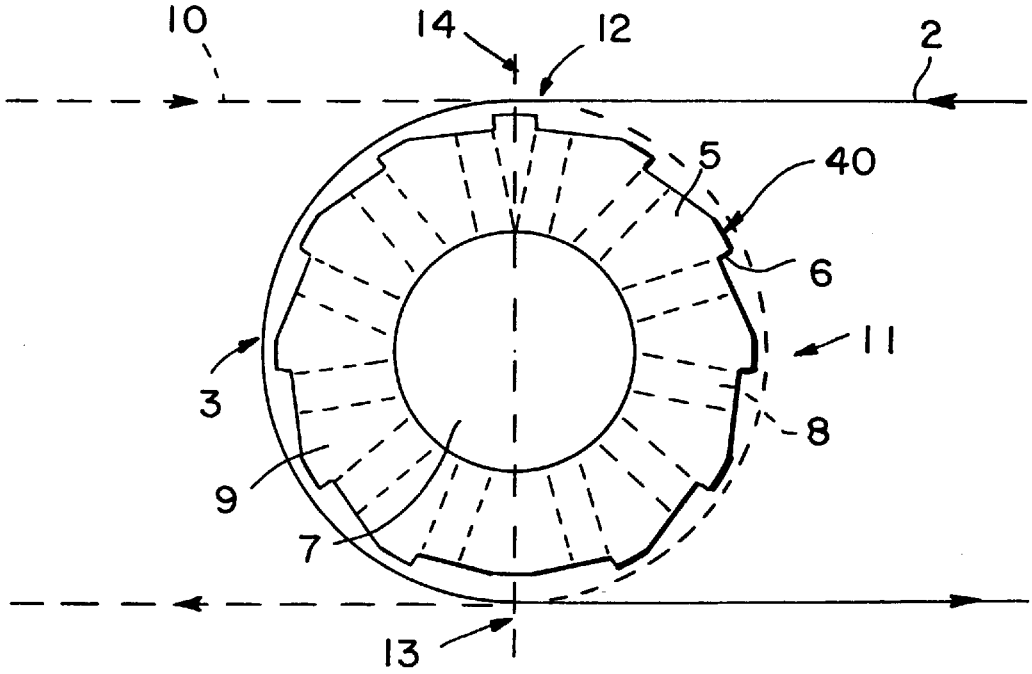
FIG. 2 shows a turner bar according to another embodiment of the present invention that is profiled over the entire outer surface of the turner bar.

FIG. 2 shows a turner bar 9 constructed as a reversible turner bar so that, in addition to a printed material web 2, it is also possible for a printed material web 10 to wrap around the turner bar 9 from the other direction. The turner bar 9 is advantageously provided on both halves 3 and 11 with a profile 40, which corresponds to the profile 4 that is doubled in mirror-image fashion in relation to a vertical axis 14. The axis 14 is defined by a run-on point 12 and a run-off point 13 of the printed material web 2 or 10.

Figure 3:
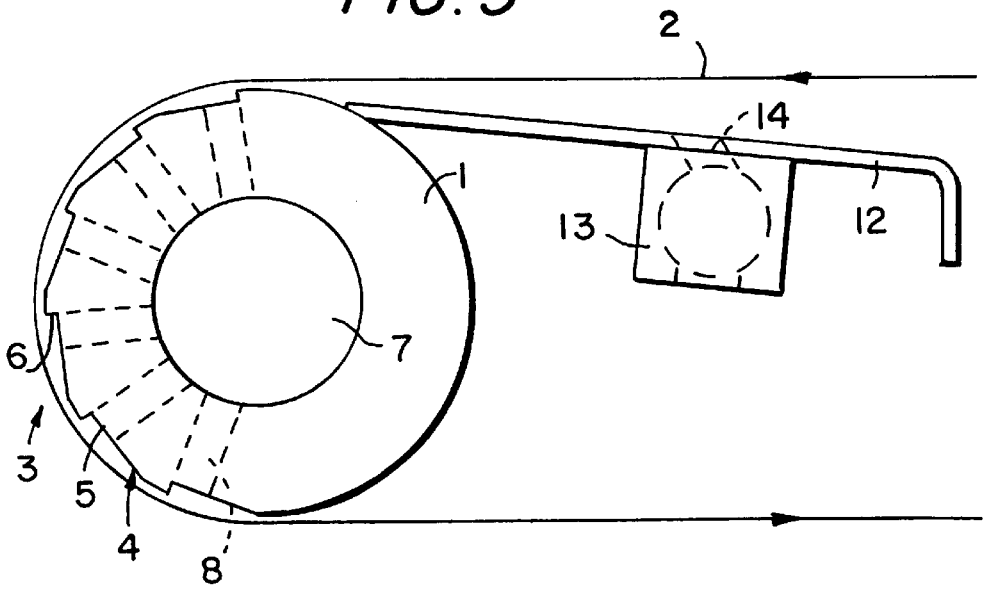
FIG. 3 shows a turner bar as in FIG. 1, on which an additional guide plate is arranged.

In a further exemplary embodiment shown in FIG. 3, an additional guide plate 12 is provided, which permits the printed material web 2 to float without contact on the turner bar 1, the turner bar in this embodiment is constructed in the same way as the turner bar 1 according to FIG. 1. The guide plate 12 is fastened to a crossmember 13 which, just like the turner bar 1, may be of hollow construction, in order to feed air, in particular compressed air, via openings 14 which extend across the guide plate 12 transversely with respect to a direction of movement of the printed material web 2.

Figure 4:
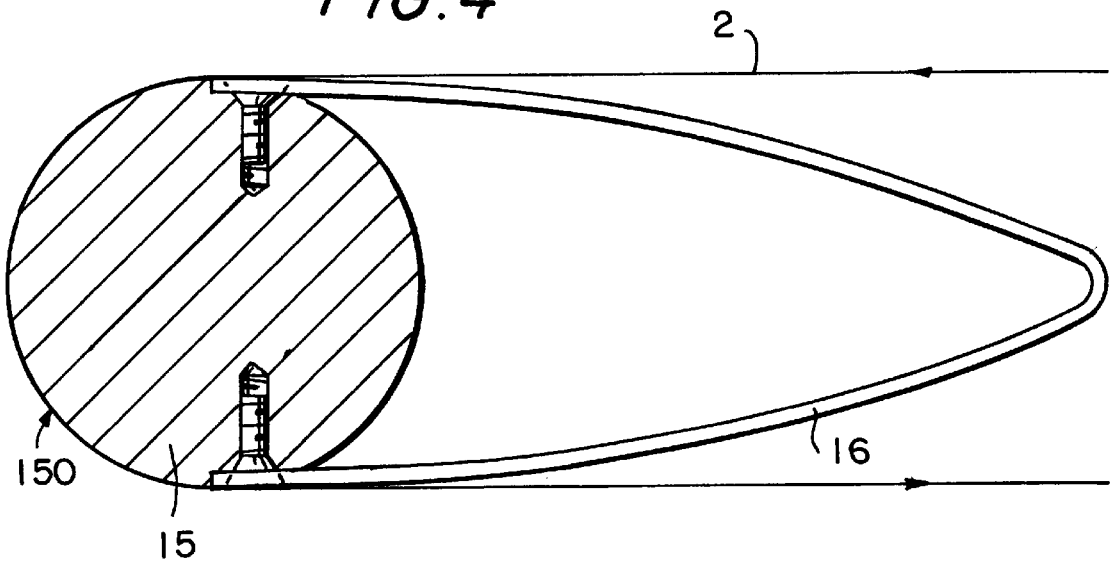
FIG. 4 shows another embodiment of the turner bar according to the invention having the profile of an aerofoil.

In a further exemplary embodiment shown in FIG. 4, a turner bar 15 is provided with an aerofoil profile 16. In this case too, it is possible for there to be either a hollow interior in the turner bar 15, in conjunction with axial holes, or air-feed openings in the region of the aerofoil profile 16, so that the printed material web 2 is led around the turner bar 15 on an air cushion. On one side 150 opposite the areofoil profile 16, the turner bar 15 has a circular cross section. Instead of a circular cross section, the side 150 may have a profile 4 like the turner bar 1 of FIG. 1.

The measures described above are used to enhance the air cushion that is produced by air friction between the turner bar 1, 9, 15, on the one hand, and the printed material web 2, 10, on the other hand, so that this cushion is sufficient to cause the printed material web 2, 10 to float "without contact" as it wraps around 180°, it being possible for a still higher inflow pressure to be produced by the addition of a guide plate 12 or an aerofoil profile 16, so that the air cushion is maintained for a longer period of time and keeps the printed material web 2, 10 in the floating state.

A further advantageous measure for reducing the air friction between the printed material web 2 and the turner bar 1 comprises the latter having a very smooth, hard and wearresistant surface with a low coefficient of friction. This measure may be realized both in conjunction with the above described profile shapes, for example of the profile 4 or of the aerofoil profile 16, and independently thereof.

Figure 5:
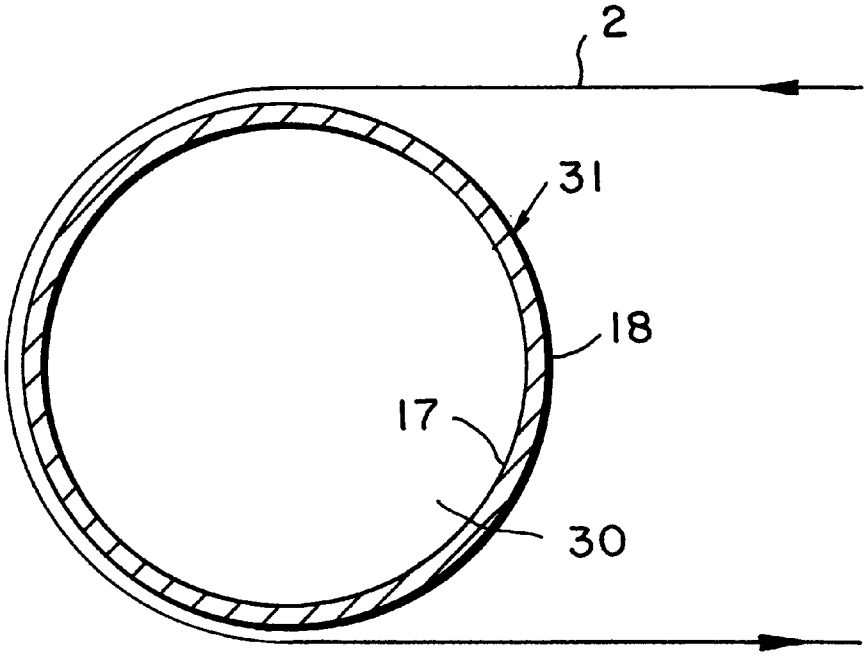
FIG. 5 shows another embodiment of a turner bar according to the invention having a coating.

Referring now to FIG. 5, another embodiment of a turner bar 31 is constructed as a solid tube. An inner element 30 consists, for example, of a solid steel tube, the steel having a Rockwell hardness of, for example, 55 HRC or more. Instead of the solid steel tube, it is also possible to use a hollow tube, which is preferably likewise formed of steel. Applied on top of the inner element 30 is a chromium layer 17, which preferably has a Vickers hardness of 850 HV or more. The chromium layer 17 is coated with amorphous, modified, superhard carbon (a-C:H), which forms a layer 18. This layer 18 preferably has a Vickers hardness of 3000 HV or more. Amorphous carbon of this type, which contains a further 20 to 30 atom-percentage of hydrogen, that is to say one hydrogen atom added to approximately 3 to 5 carbon atoms in a layer, is known from the article "Structure and bonding of hydrocarbon plasma generated carbon films: an electron energy loss study" by Fink, J., T. M üller-Heinzerling, J. Pflüger, A. Bubenzer, P. Koidl and G. Crecellus, Solid State Commun. 47 (1983), p. 687. This carbon modification, which is neither pure graphite nor pure diamond, is produced by ion bombardment. The moving printed material web 2 produces an extremely small amount of friction on this layer. As an alternative to using amorphous, superhard, modified carbon, the layer 18 may comprise diamond. The layer 18 preferably has a surface roughness $R_a$ of at most 0.3 $\mu$m.

Figure 6:
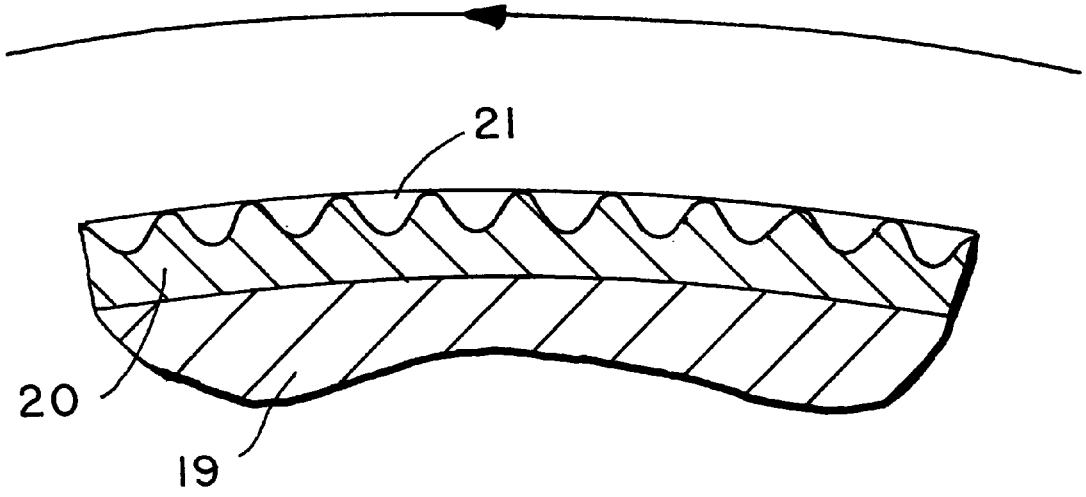
FIG. 6 shows a detail of a cross section of yet another embodiment of the turner bar having a coating.

Equally beneficial frictional behavior is exhibited by silicone or polytetrafluoroethylene. However, since this material is not wear-resistant, it must be embedded in a very hard and rough surface made of, for example, tungsten carbide. Referring to FIG. 6, a turner bar 19 has a layer 20 of tungsten carbide, in whose depressions 21 silicone or polytetrafluoroethylene is embedded. These materials have the property of repelling ink. Since said materials are very soft, it is not necessary to grind the turner bar 19 after the application of the silicone or of the polytetrafluoroethylene to the granular surface formed by the tungsten carbide. Instead of grinding, excess silicone or excess polytetrafluoroethylene is worn off by the frictional movement of the printed material web 2 on the turner bar 19. This then produces a coating, on the outer surface of the turner bar 19, which has a very low coefficient of friction. The turner bar 19 likewise has an inner element 30, not illustrated in FIG. 6, made of a solid tube or a hollow tube made of steel.

As an alternative to using tungsten carbide, it is also possible to use a ceramic, in whose valleys Teflon or polytetrafluoroethylene is embedded.

The invention includes a turner bar 1 which, on account of its profile 4, enables air cushions to be built up between its outer surface and a printed material web 2. In addition, or as an alternative, to these measures, a guide plate 12 or an aerofoil profile 16 may be arranged on the turner bar 1, 15. Compressed air may also be fed from radial holes 8 or from holes 14 in the guide plate 12 further reduce sliding friction of the printed material web 2.

The invention is not limited by the embodiments described above which are presented as examples only but can be modified in various ways within the scope of protection defined by the appended patent claims.

We claim:

1. A turner bar for turning a printed material web in a web-fed rotary printing machine, wherein said turner bar comprises a first profile on an outer surface of said turner bar effective for building up an air cushion between said outer surface and the printed material web when said turner bar is held in a fixed position and the printed material web is fed around said turner bar.

2. The turner bar of claim 1, wherein said first profile includes sawtooth elevations in said outer surface of said turner bar, each sawtooth elevation comprising a gently rising side and a steeply falling side, wherein the printed material web is fed first over said gently rising side and then over said steeply falling side.

3. The turner bar of claim 2, further comprising an interior cavity in communication with an exterior of said turner bar through radial holes connecting said interior cavity through said gently rising sides of said sawtooth elevations.

4. The turner bar of claim 1, comprising a second profile arranged mirror-symmetrically with respect to said first profile with gently rising sides and steeply falling sides such that the printed material web is turnable about said turner bar from either of two opposing directions.

5. The turner bar of claim 1, further comprising a guide plate arranged upstream of said turner bar in a feeding direction of the printed material web.

6. The turner bar of claim 5, wherein said guide plate comprises openings through which air is fed into the region between said guide plate and the printed material web.

7. The turner bar of claim 1, wherein a cross-sectional profile of said turner bar comprises an aerofoil shape.

8. The turner bar of claim 1, wherein said turner bar includes an outer layer forming said outer surface, wherein said outer layer comprises one of an amorphous, modified, superhard carbon (a-C:H) and a diamond.

9. The turner bar of claim 8, wherein said outer surface comprises a roughness $R_a$ no greater than 0.3 $\mu$m.

10. The turner bar of claim 8, wherein said outer layer comprises a Vickers hardness of at least 3000 HV.

11. The turner bar of claim 8, further comprising a chromium layer under said outer layer.

12. The turner bar of claim 11, wherein said chromium layer comprises a Vickers hardness of at least 850 HV.

13. The turner bar of claim 8, further comprising an inner element formed by one of a solid tube and a hollow tube, and wherein said inner element comprises steel.

14. The turner bar of claim 13, wherein said inner element comprises a Rockwell hardness of at least 55 HRC.

15. The turner bar of claim 1, wherein said outer surface includes a layer comprising one of tungsten carbide and ceramic having irregularities forming depressions and a filler material filling said depressions.

16. The turner bar of claim 15, wherein said filler material comprises one of silicone and polytetrafluoroethylene.

17. The turner bar of claim 15, further comprising an inner element formed by one of a solid tube and a hollow tube, and wherein said inner element comprises steel.

18. The turner bar of claim 17, wherein said inner element comprises a Rockwell hardness of at least 55 HRC.

* * * * *